US005809383A

United States Patent [19]

Van Goethem et al.

[11] Patent Number: 5,809,383

[45] Date of Patent: Sep. 15, 1998

[54] ELECTROSTATIC DEVELOPING DEVICE

[75] Inventors: Luc Van Goethem, Sint-Gillis-Waas; Robert Janssens, Geel; William Waterschoot, Belsele; Erik Van Echelpoel, Lier, all of Belgium

[73] Assignee: Agfa-Gevaert N.V., Mortsel, Belgium

[21] Appl. No.: 886,691

[22] Filed: Jul. 1, 1997

[30] Foreign Application Priority Data

Jul. 1, 1996 [EP] European Pat. Off. ..... 96201825

[51] Int. Cl.[6] ..... G03G 15/08

[52] U.S. Cl. ..... 399/258; 399/260

[58] Field of Search ..... 399/254, 255, 399/256, 258, 260; 366/156.2, 266, 318

[56] References Cited

U.S. PATENT DOCUMENTS 4,367,954 1/1983 Ganz et al. ..... 366/156.2

5,142,333 8/1992 Verbeek et al. ..... 399/256

5,495,320 2/1996 Araki et al. ..... 399/256

*Primary Examiner*—Arthur T. Grimley

*Assistant Examiner*—Hoan Tran

*Attorney, Agent, or Firm*—Baker & Botts, L.L.P.

[57] ABSTRACT

An electrostatic developing device comprising feed passages (54, 58) for a two-component developer, a hopper (43) for adding fresh toner to the developer to maintain its concentration at a desired level, and a mixer with a vertical helical mixer screw (63) rotatable in a stationary housing (42) and a sleeve (65) surrounding the screw in the housing, an annular space (69) being left between the sleeve and the housing allowing developer transported upwardly by the mixer screw within the sleeve to return via the annular space to the lower end of the screw and then become circulated upwardly again.

11 Claims, 6 Drawing Sheets

ELECTROSTATIC DEVELOPING DEVICE

BACKGROUND OF THE INVENTION

1. Field of the Invention

This invention relates to electrostatography, more specifically to an electrostatic developing device in which fresh toner is mixed with a developer containing toner particles and carrier particles.

2. Description of the prior art

In electrostatography a latent image is formed by (i) applying an imagewise charge distribution to a dielectric, (ii) developing the latent image, i.e. converting it to a visible image by depositing thereon selectively light-absorbing particles, called toner particles. The toner particles are mostly electrically charged. The image, made visible by the deposition of toner particles on the latent image that was present on the dielectric, is then transferred to a substratum and fixed thereon to yield the final copy. In electrophotography, which is a special embodiment of electrostatography, the dielectric is a photoconductor and an image is formed by (i) uniformly charging a photoconductor, (ii) imagewise discharging it so as to obtain a latent image, (iii) developing the latent image, i.e. converting it to a visible image by depositing toner particles on the latent image. The image, made visible by the deposition of toner particles on the latent image that was present on the photoconductor, is then transferred to a substratum and fixed thereon so as to yield the final copy.

For the application of toner development two methods are known: "dry-powder" and "liquid-dilapersion" development. At present the dry-powder method in the most commonly used. More details on the dry-powder development can be found a.o. in IEEE Transactions on Electronic Devices, Vol. ED-19, no. 4, April 1972, pp. 495–511.

In the dry-powder process the toner particles are charged triboelectrically by mixing them, viz. shaking them together with the carrier particles (toner- and carrier particles have an opposite charge). The mixture of carrier particles and toner particles that are attracted electrostatically by the carrier particles, is the developer.

During development the toner particles are released by the carrier particles and deposited on the latent image that has been applied to a dielectric. The toner particles are thus the consumable in the developer. This implies that the developer gets exhausted upon being used, i.e. very few toner particles are left in the mixture with the carrier particles. For being able to continue developing latent image, toner has to be added. This fresh toner particles are still uncharged and have to be mixed (shaken) again in the apparatus with the carrier particles for charging them triboelectrically.

In an electrostatographic process it is very important that the charging of all toner particles be as uniform as possible, i.e. that the charge distribution of the toner particles be narrow. Care is taken via the toner composition that the toner particles, when they are treated in the same way, also possess a narrow charge distribution, see e.g. EP-A 0 488 741, EP-A 0 488 742. In order to give all toner particles approximately the same charge it is important that they be subjected to the same treatment, viz. come into contact with the carrier particles in the same way, i.e. as intensively as frequently, during the mixing process of fresh toner particles with the exhausted developer.

From the point of view of today's standards set to the copy or print it is desirable not to use developing techniques such as powder-cloud development or cascade development, but instead to apply magnetic-brush development. For using such a development system it is necessary to realise an optimised system for mixing carrier particles and toner particles, and to couple this mixing system with a magnetic-brush system. Various mixing systems are known for charging the toner particles, most of which, however, exert a mechanical force on the toner particles and carrier particles. So, in U.S. Pat. No. 4,456,364 mixing the developer (toner particles and carrier particles) is recommended by allowing a thread provided with loops to rotate in the container of the developer. In EP-A 161 795 a special shaft equipped with mixing blades rotates in the developer, and in U.S. Pat. No. 4,583,842 worm wheels mix the developer. Although it is possible according to the cited embodiments to charge the replenished toner particles in the desired, homogeneous way and to the desired height of charge, there is still the problem of the mechanical pressure being exerted on the toner—and carrier particles, which makes them agglomerate and thus form large particles that are unsuited for a qualitatively acceptable development of the electrostatic latent image.

SUMMARY OF THE INVENTION

3. Objects of the invention

It is an object of this invention to provide a reliable, inexpensive, small and simple system for the efficient stirring of a two-component developer.

It is a further object of the invention to provide a stirring system that can be used for mixing such developer to obtain a uniform distribution of toner and carrier, as well as for triboelectrically charging the toner of such mixture.

STATEMENT OF THE INVENTION

In accordance with the present invention, an electrostatic developing device comprising a magnet roller, all feed passage for two-component developer, means in said feed passage for applying said developer to said magnet roller, means for adding fresh toner to the developer to maintain the toner concentration thereof at a desired level, and means for stirring said developer, is characterised in that said stirring means comprises a helical mixer screw inclined to the horizontal and rotatably mounted in a stationary housing with a developer inlet near the bottom and a developer outlet at a level above that of the inlet, and stationary wall means surrounding said screw in said housing, an annular space being left between said wall means and said housing allowing developer transported upwardly by said mixer screw within said wall means to return via said annular space to the lower end of the screw and then become transported upwardly again, and means for conveying a portion of said upwardly transported developer to said developer outlet.

The term "two-component" developer as used in the present specification stands for a mixture of carrier and toner particles that, however, can still contain other components such as fluidity improvers, e.g. silicon or titanium dioxides, or other polymeric particles.

It has been shown that the inventive stirring means provides an extremely efficient and rapid mixing of toner with developer. Mixing times shorter than 5s have been found for obtaining a satisfactory mixing uniformity.

Although the inventive stirring means can operate basically on its own to obtain the desired mixing and triboelectric charging of a two-component developer, it will be understood that in practice said two operations are also carried out by other moving parts of a developer station, e.g. by a helical feed and supply screw provided in corresponding feed passages for circulating the developer through the developer device and applying it on the magnet roller. This means that the stirring device according to the invention can advantageously improve mixing and triboelectrostatic charging of prior art developing arrangements.

Suitable embodiments of the invention are as follows.

The mentioned wall means has a length smaller than the length of the feed screw, and the upper and lower ends of the feed screw extend beyond said wall means.

The annular space extends over 360 angular degrees.

The means for conveying a portion of developer to the outlet of the stirring device comprises a slide surface catching a portion of developer overflowing the top edge of the wall means. This wall means can suitably have the form of a cylindrical sleeve.

The mentioned slide surface can be formed by a slanting platform angularly surrounding said sleeve over a certain angle, but this slide surface can also be formed by a portion of the top edge of such sleeve in case both the sleeve and the feed screw are mounted obliquely.

BRIEF DESCRIPTION OF THE DRAWINGS

The invention will be described hereinafter by way of without limiting it thereto with reference to the accompanying drawings, wherein.

Figure 1:
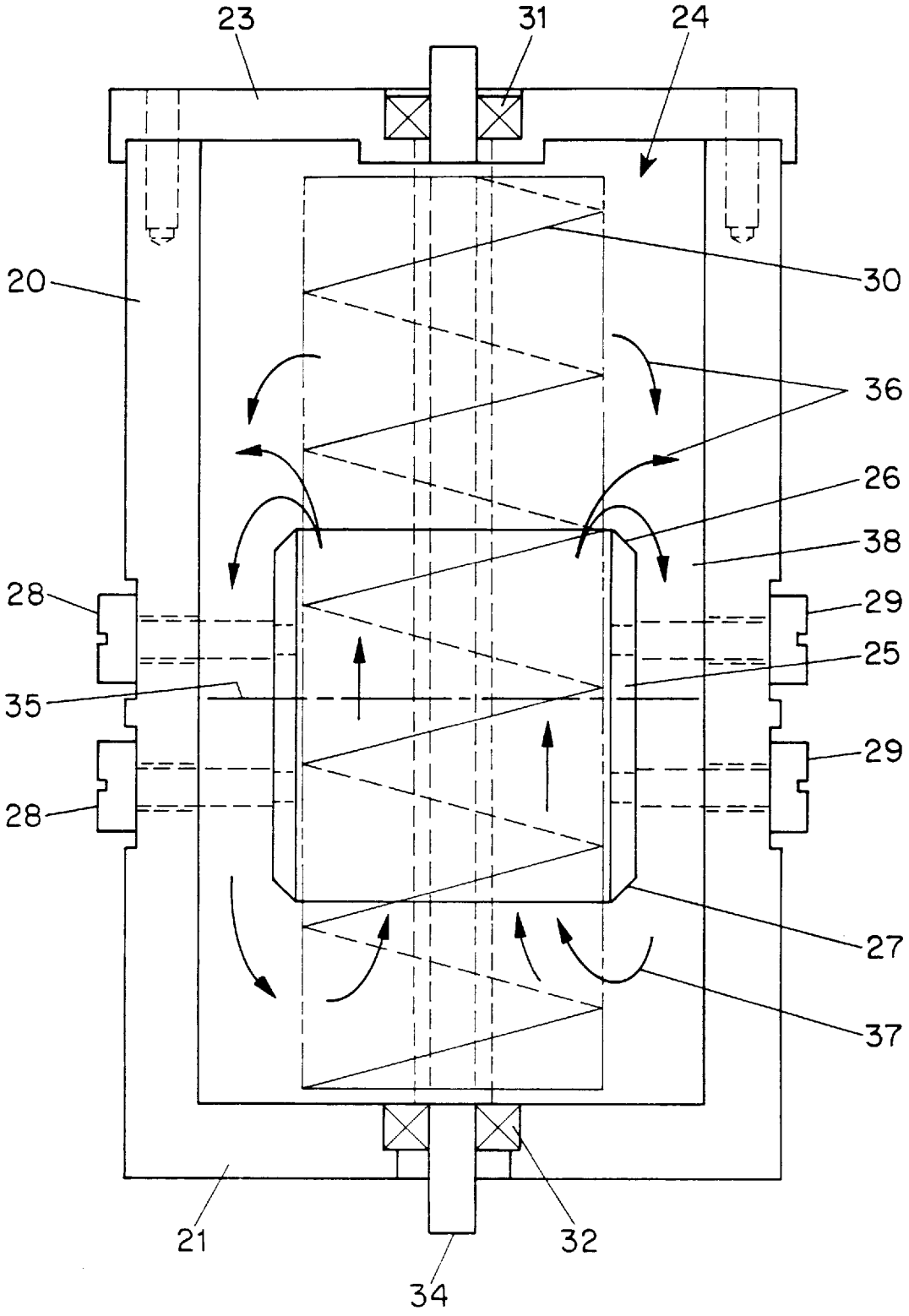
FIG. 1 is a diagrammatic view of a vertical mixer illustrating the principle of the invention.

The mixer shown in FIG. 1 consists of a vertical cylindrical housing 20 with a bottom 21 and a beam 23 on its open top end 24. The housing was made from a transparent material, in the present case Plexiglass (Registered Trade name). A metal cylindrical sleeve 25 with bevelled top and bottom edges 26 and 27 is mounted concentrically within the housing by means of opposed pairs of screws 28 and 29. A helical transport screw 30 is rotatably mounted in the housing by means of bearings 31 and 32. Driving means is provided, not shown, for driving screw 30 in a direction such that its helical blade performs an upwardly directed transport movement. The axis of the screw coincides with the axis of housing 20 and sleeve 25. The diameter of the screw was 30 mm. The gap between the screw and the sleeve amounted to approximately 2 mm.

Screw 30 was machined from a plastic cylinder fitting on a stainless steel shaft 34.

The efficiency of the mixer was tested by filling it with 400 g of black-coloured developer containing 4 g of toner, reaching a level as indicated by dot-and-dash line 35. Next, an amount of 0.5 g of yellow-coloured toner was poured in the device at the position of arrow 24. It could be seen that developer which was thrown radially outwardly, see arrow 36, by screw 30 rotating at 500 rpm, rapidly catched the toner flowing into the device and intersected the mass thereof as it were with a great plurality of sheets of developer. The mass thus mixed flows downwardly through annular space 38 between sleeve 25 and housing 20 and next is catched by the helical screw, see arrows 37, and moved upwardly while undergoing shearing and compression forces. The portion of the developer mass in the space between screw 30 and sleeve 25 is not directly catched by the screw and thereby remains for a longer time within the sleeve, thereby exhibiting increased frictional forces. A purely visual evaluation of this test shows that a very good mixing of the yellow toner with the black developer was obtained in less than 5 seconds.

A mixer as described hereinbefore was incorporated in an electrophotographic developing device, and this device is described hereinafter with reference to FIGS. 2 to 9.

Figure 2:
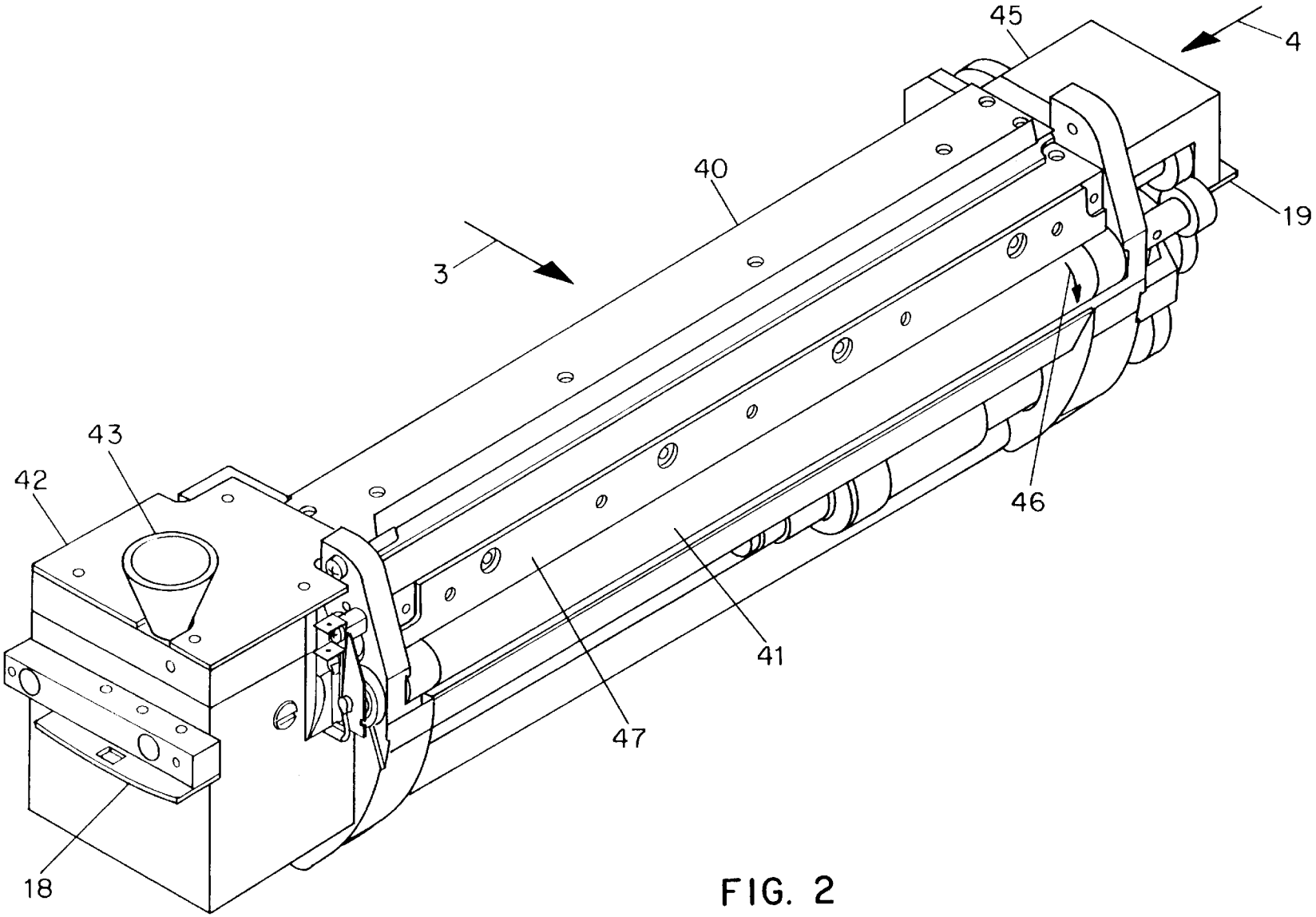
FIG. 2 is an isometric view of one embodiment of an electrostatic developing device according to the invention.
Figure 4:
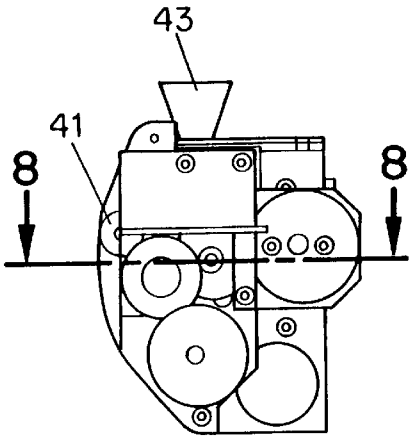
FIG. 4 is a side view according to arrow 4 of FIG. 2.

FIG. 2 is an isometric view of device 40 which on its front side has a so-called magnet roller 41 consisting of a non-ferromagnetic sleeve rotatable around a magnet arrangement and slightly protruding from the device for applying a layer of developer adhering in the form of a brush to its outer surface on a photo-conductor drum which rotates closely adjacent to such magnet roller and bears on its surface an image-wise electrostatic charge pattern that must be developed. This developer system is known as magnetic brush development. Typically, a magnetic brush development system employs a magnetizable developer material including magnetic carrier granules having toner particles adhering tribolelectrically thereto. The developer material is continually brought through a directional flux field to form a brush of developer material. The developer particles are continuously moving so as to provide the brush consistently with fresh developer material. The toner image resulting from such development is next transferred from the photoconductor drum to a plain paper receiver sheet and then fixed, all as known in the art. The device is provided with lateral supporting elements 18 and 19 for easily and reproducibly fitting in an electrophotographic engine.

The left-hand part of the figure shows the mixer arrangement 42 with a toner hopper 43 whereas the right-band part is the driving mechanism 45 with inter-engaging gears for the driving of the rotatable rollers of the device. Magnet roller 41 rotates in the direction of arrow 46 and the thickness of the layer of developer supplied to its surface is metered by adjustable doctor blade 47. The representation of toner hopper 43 is diagrammatic only, and it will be understood that in practice the toner addition system will comprise a toner cartridge or bottle suitably and removably connected to the device, and a metering system for feeding controlled amounts of toner to the developer device.

Figure 3:
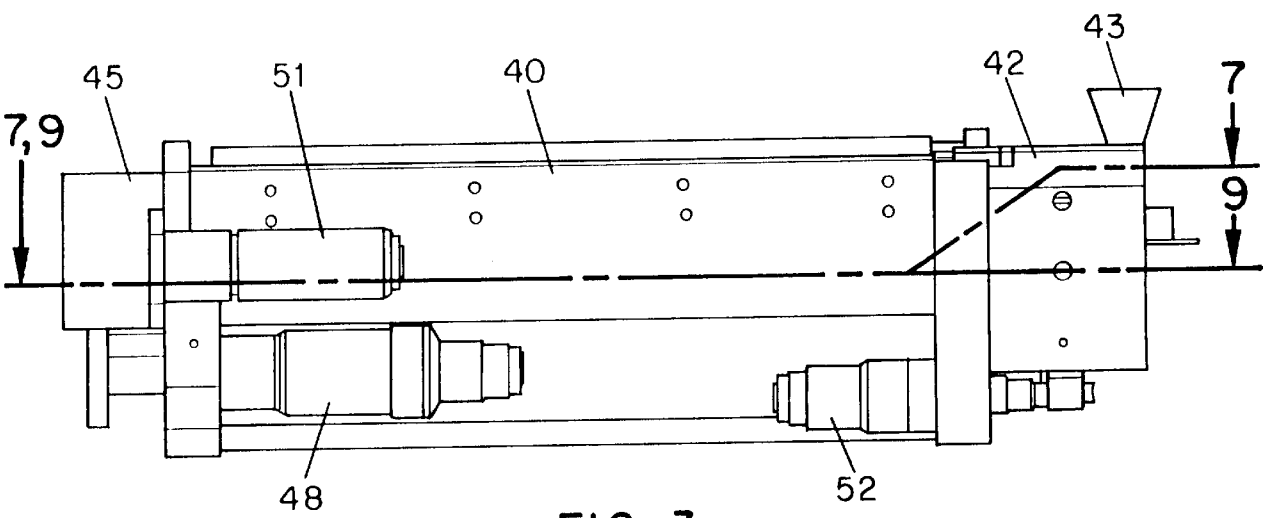
FIG. 3 is a rear view according to arrow 3 of FIG. 2.
Figure 5:
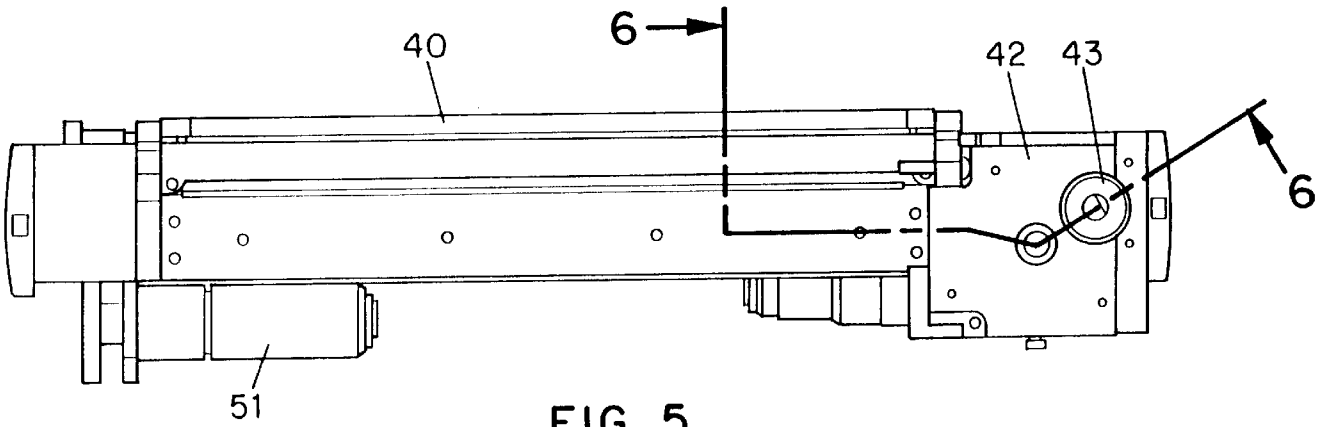
FIG. 5 is a top view of the device according to FIG. 2.

FIG. 3 shows the rearside of the device with motor 48 for driving the helical feed and the supply screw 49, resp. 50 of the device, motor 51 for driving magnet roller 41, and motor 52 for driving the helical mixer screw of mixer 42, whereas Pig. 4 is a lateral view of the gear mechanism, see arrows 3 and 4 of FIG.2. FIG. 5 is a top view of the device. These figures allow to distinguish the various isometric sectional views in FIGS. 6, 7 and 8.

Figure 9:
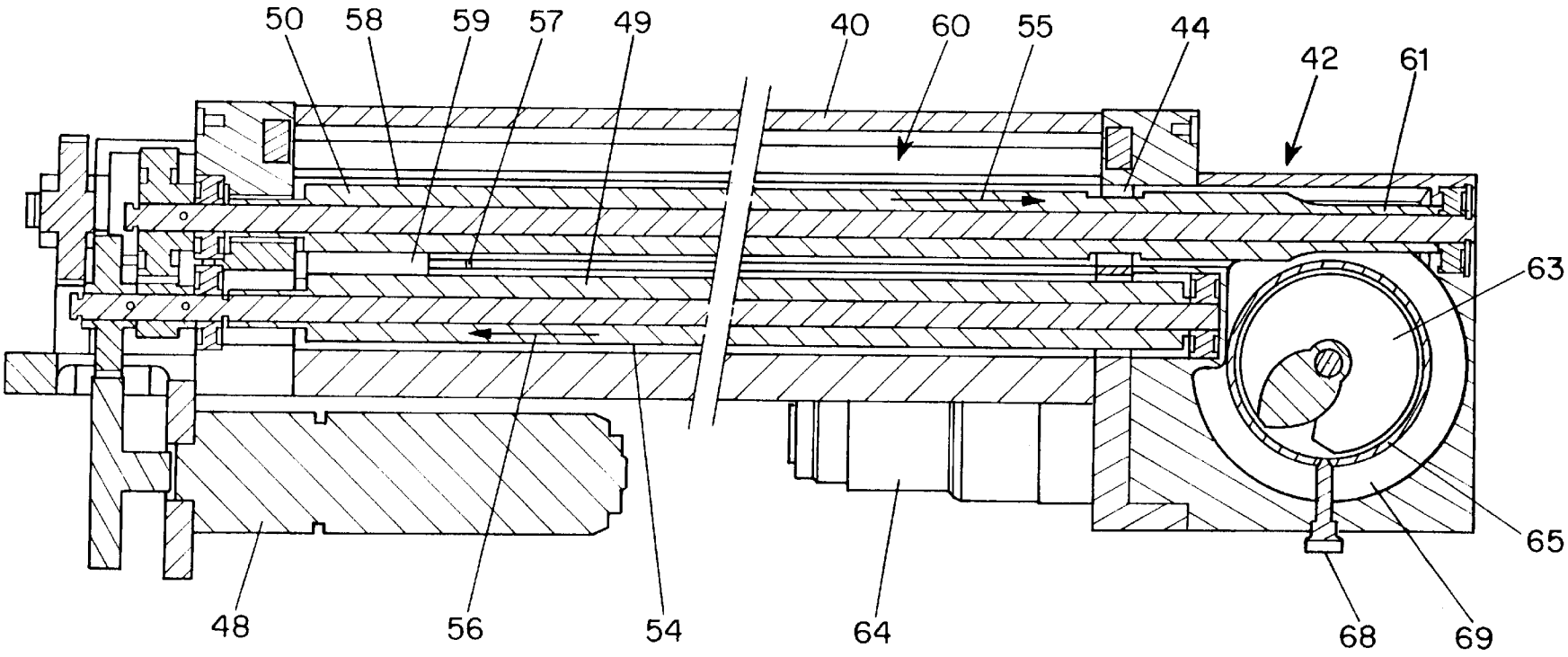
FIG. 9 is a horizontal sectional view on line 9—9 of FIG. 3.

FIG. 9 is a horizontal sectional view on line 9—9 of FIG. 3 showing the circulation of the developer through the device. Feed screw 49 rotates in a first elongate feed passage 54 for moving developer received from mixer 42 in the direction of arrow 56 towards the opposite lateral end wall of the device. The feed screw has been shown completely sectioned, but it is clear that such screw actually is a shaft provided with a helical blade and is rotated in a direction such that the toner transport occurs in the indicated direction. Feed passage 54 is an elongate gutter-like channel semicircular in cross-section. A partition wall 57 that separates feed passage 54 from adjacent feed passage 58 has near its end an opening 59 through which the developer can flow from passage 54 into passage 58 in which supply screw SO causes movement of the developer in the opposite direction, see arrow 55. Both feed passages 54 and 58 run horizontally and are located at the same height, as are the corresponding screws 49 and 50.

Magnet roller 41 which is not visible in the view of FIG. 9 since it is located higher than the intersection plane, has a position that coincides practically with that of the open space 60 in the figure. The magnet roller attracts over its complete length developer from supply screw 50, and the thickness of this layer of picked-up developer is metered by doctor blade 47 mentioned already.

Supply screw 50 extends through input opening 44 tangentially to screw 63 of mixer 42 and has an end section 61 of reduced diameter.

The operation of the feed and supply screw in the corresponding feed passages which causes mixing, electrostatic charging and circulation of the developer is known in the art and needs therefore no further explanation. If desired, a more detailed description can be found in our EP 0 437 864 131 relating to an electrostatic latent image developing device.

Figure 6:
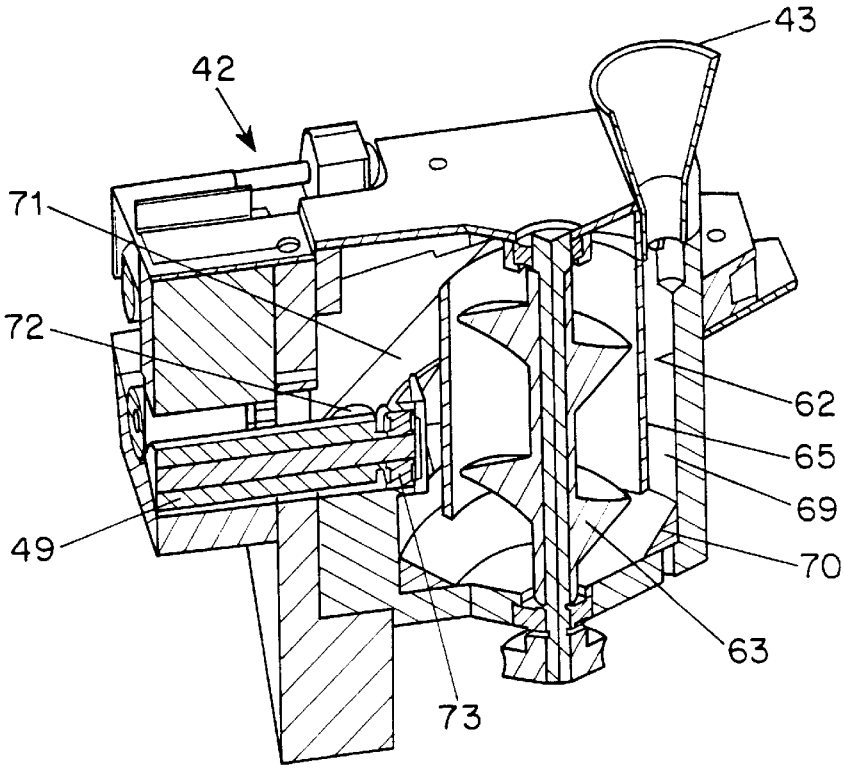
FIG. 6 is an isometric view, partly broken away according to line 6—6 of FIG. 5.

The construction of mixer 42 is as follows with reference to FIGS. 6 to 8.

The mixer basically comprises a housing with a vertical cylindrical cavity 62 in which a rotatable helical mixer screw 63 is drivingly connected with motor 52. A cylindrical sleeve 65 with bevelled top edge 66 is concentrically and stationary slanted within cavity 62 by means of opposed screws such as 67 and 68 passing through the wall of the housing. The length of the sleeve is shorter than the length of screw 63 and the top and bottom end of this screw extend beyond the sleeve. A tapered ring 70 at the bottom of the cavity provides a smooth cross-over from annular space 69 to the lower end of the screw.

The annular space is provided at its top end with a slanting wall 71 forming a slide surface connected with the surfaces of both cavity 62 and sleeve 66. Wall 71 has an initial width legal to the diameter of cavity 62 and a width at the bottom equal to the width of feed passage 54. The lower land of this wall 71 has an opening 72 through which the end of feed screw 49 extends up to its journal 73, see FIG. 6. The axis of feed screw 49 intersects the axis of mixer screw 63.

Figure 7:
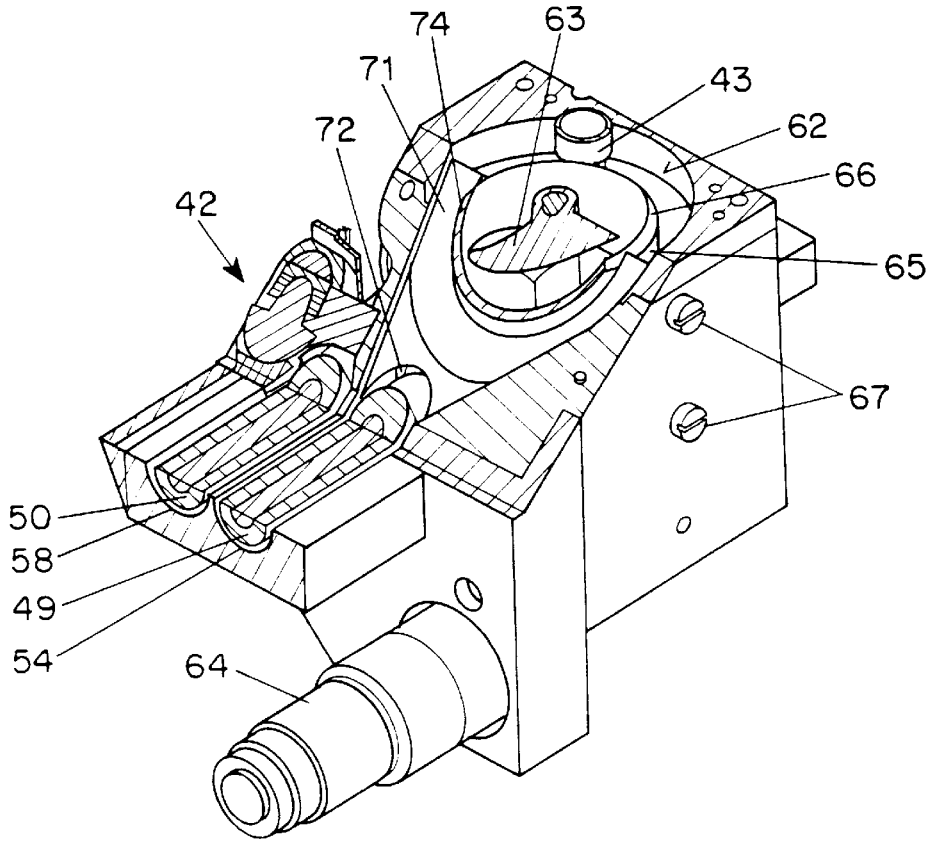
FIG. 7 is an isometric view, partly broken away according to line 7—7 of FIG. 3.
Figure 8:
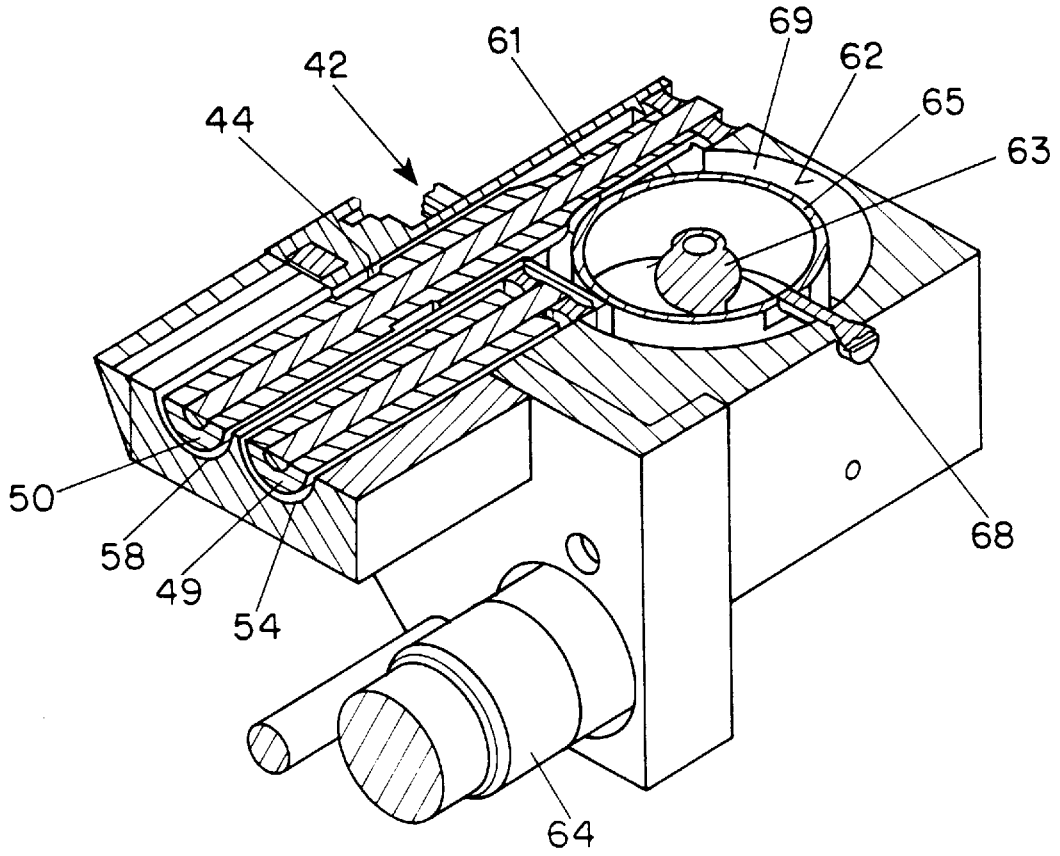
FIG. 8 is an isometric view partially broken away according to line 8—8 of FIG. 4.

Section 74 of sleeve 65 in FIG. 7 results from the cutting of this sleeve on line 7—7 of FIG. 3. The described slide surface 71 is completely below this section plane in FIG. 3 and is therefore not intersected in FIG.7.

Supply screw 50 extends further in the milling device than does feed screw 49. As a matter of fact, screw 50 extends tangentially to the lower end of mixer screw 63, see FIGS. 8 and 9.

In operation of the device, and the device being filled with a developer mixture of suitable toner concentration, rotating mixer screw 63 moves the developer in mixer 42 upwardly until it flows over the top edge of sleeve 65. Developer flowing over the outside half (180 angular degrees) of this edge falls downwardly through annular space 69 to the bottom of the mixer where it is catched by the screw and moved upwardly again. Developer flowing over the inside half (180 degrees as well) of the top edge of sleeve 65 does not flow into the annular space but, on the contrary, flows over slide surface 71 towards feed screw 49 in feed passage 54. Screw 49 transports the developer towards its opposite end, up to opening 59 in partition wall 57 where it enters into the adjacent feed passage 58. Supply screw 50 in the latter passage returns the developer to mixer 42 and completes in that way the circulation of the developer.

Developer returned by screw SO to the bottom of the mixer becomes mixed with developer flowing downwardly through annular space 69, and is intensively stirred and circulated a plurality of times through the mixer before arriving on slide surface 71 and being fed again to feed screw 49.

Supply screw 50 applies developer to magnet roller 41 and as the latter roller develops the latent electrostatic image as described already, the toner concentration of the developer decreases. The toner concentration of the developer may be monitored in any way known in the art, to control a metering system in the circuit of hopper 43 so that appropriate amounts of toner may timely be added to the mixer to become thoroughly mixed with exhausted developer therein.

An electrostatic developing device according to the present invention is not limited to the embodiment described hereinbefore.

The feed screw and the supply screw must not necessarily lie in one plane but may be situated at different levels. Also, the feed screw can take a slanting position, as known in the art. Furthermore, the device can comprise two or even more feed screws.

The feed and supply screws basically consist of a shaft portion and a helical blade fitted thereon as described already. The pitch of the helical blade may be uniform over the length of the screws but may also vary to obtain appropriate control of the transport, mixing and electrostatic charging functions for the developer. A feed screw can further comprise small, axially spaced zones where the pitch of the helical blade is reversed, so that a local backward feed instead of a forward one is obtained. This arrangement produces local impoundages of developer in the feed passage leading to improved mixing and/or charging. Also the downstream end of the feed and/or supply screw can have a reversed pitch in order to reduce pressure of the developer on the sealed bearing of the screw(s).

The driving mechanism for the feed and supply screws, the magnet roller and the mixer may comprise one instead of three motors.

Finally, the helical mixer screw and its corresponding sleeve and housing can also take a slanting position instead of a truely vertical one. In this way mixed developer flowing over the lowest point of the correspondingly inclined top edge of the sleeve can flow directly towards a corresponding feed passage without need for a slide surface.

We claim:

1. An electrostatic developing device comprising a magnet roller (46), a feed passage (58) for two-component developer, means (50) in said chamber for applying said developer to said magnet roller, means (43) for adding fresh toner to the developer to maintain the toner concentration thereof at a desired level, and means for stirring said developer, characterised in that said stirring means comprises a helical mixer screw (63) inclined to the horizontal and rotatably mounted in a stationary housing (42) with a developer inlet (44) near the bottom and a developer outlet (66) at a level above that of the inlet, and stationary wall means surrounding said screw in said housing, an annular space (69) being left between said wall means and said housing allowing developer transported upwardly by said mixer screw within said wall means to return via said space to the lower land of the screw and then become transported upwardly again, and means for conveying a portion of said upwardly transported developer to said outlet opening.

2. An electrostatic developing device according to claim 1, wherein said annular space (69) extends over 360 angular degrees.

3. An electrostatic developing device according to claim 1, wherein said wall means has a length shorter than the length of said mixer screw.

4. A developing device according to claim 3, wherein the lower and upper end of said mixer screw extend beyond said wall means.

5. An electrostatic developing device according to claim 1, wherein said stationary wall means is formed by a cylindrical sleeve (65).

6. An electrostatic developing device according to claim 1, wherein said means for conveying a portion of said upwardly transported developer to said outlet opening comprises a slide surface (71).

7. An electrostatic developing device according to claim 5, wherein said slide surface has an angular extent of 180 degrees around said sleeve.

8. A developing device according to claim 1, wherein said mixer screw (63) is vertical.

9. A developing device according to claim 1, wherein said mixer screw runs obliquely.

10. A developing device according to claim 5, wherein said sleeve (65) has a bevelled top edge (66).

11. A developing device according to claim 1, wherein said means for applying said developer to said magnet roller comprises a feed screw (49) and a supply screw (50), the feed screw extending radially and the supply screw extending tangentially to the mixer screw (63) in the mixer housing.

* * * * *

UNITED STATES PATENT AND TRADEMARK OFFICE

CERTIFICATE OF CORRECTION

PATENT NO. : 5,809,383

DATED : September 15, 1998

INVENTOR(S) : Luc Van Goethem, et al.

It is certified that error appears in the above-identified patent and that said Letters Patent is hereby corrected as shown below:

Title page, insert the following item:

--[60] Provisional application No. 60/027,503 filed September 27,1996--

Column 1, line 5, insert the following:

--CROSS REFERENCE TO RELATED APPLICATION--

Reference is made to and priority claimed from U. S. provisional application Serial No. U. S. 60/027,503, filed September 27, 1996, entitled ELECTROSTATIC DEVELOPING DEVICE.--

Signed and Sealed this

Twenty-third Day of March, 1999

*Attest:*

Q. TODD DICKINSON

*Attesting Officer*

*Acting Commissioner of Patents and Trademarks*